United States Patent [19]

Napflin

[11] 4,441,732

[45] Apr. 10, 1984

[54] SKI BINDING WITH A FOOT SUPPORT

[76] Inventor: Hans Napflin, Kastanienallee 5, Beckenried, Switzerland, CH 6375

[21] Appl. No.: 301,028

[22] Filed: Sep. 10, 1981

[30] Foreign Application Priority Data

Oct. 27, 1980 [AT] Austria ..... 5282/80

[51] Int. Cl.[3] ..... A63C 9/08

[52] U.S. Cl. ..... 280/614; 280/618; 280/633

[58] Field of Search ..... 280/614, 615, 618, 620, 280/623, 631, 633, 636; 403/323; 16/237, 249, 233, 242

[56] References Cited

U.S. PATENT DOCUMENTS

| | | | |
|---|---|---|---|
| 3,649,039 | 3/1972 | Gertsch | 280/620 |
| 4,083,578 | 4/1978 | Moog | 280/618 |
| 4,116,463 | 9/1978 | Zoor | 280/615 |
| 4,152,009 | 5/1979 | Schmid | 280/614 |

*Primary Examiner*—David M. Mitchell
*Assistant Examiner*—Joseph McCarthy
*Attorney, Agent, or Firm*—Tilton, Fallon, Lungmus & Chestnut

[57] ABSTRACT

A ski binding with foot support having a U-shaped member in which notches are provided on the underside. A shackle rides on each leg and has a C-shaped heel bracket pivotally connected thereto with the ends of the bracket being positionable in various of the notches.

5 Claims, 4 Drawing Figures

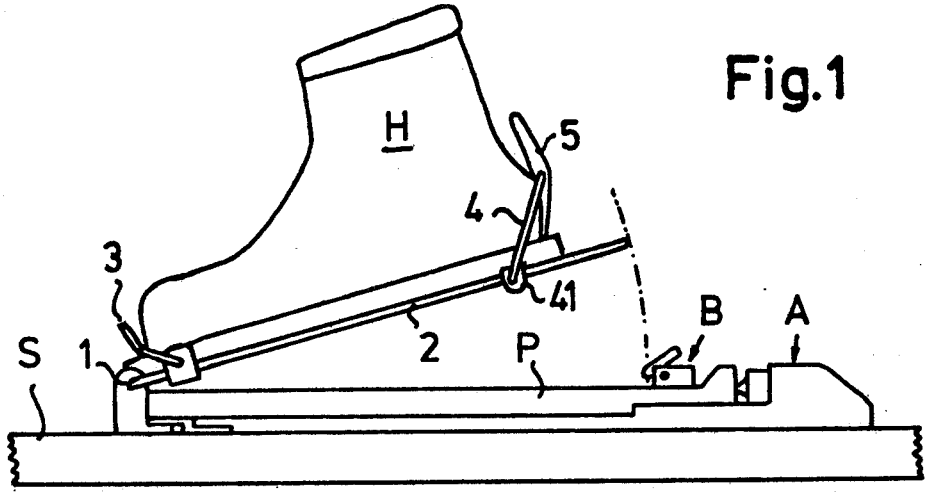
Fig.1
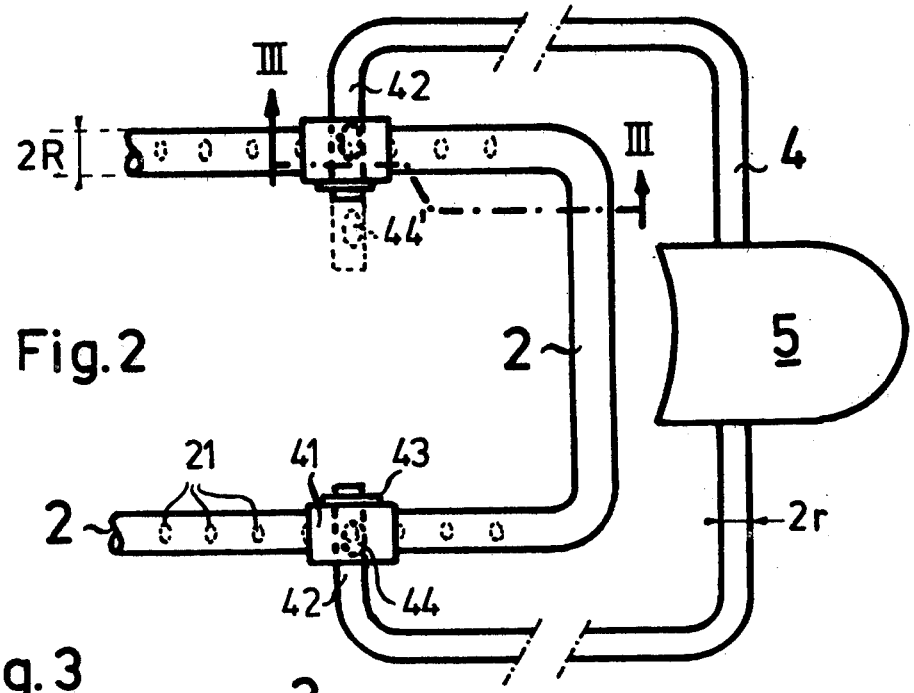
Fig.2
Fig.3
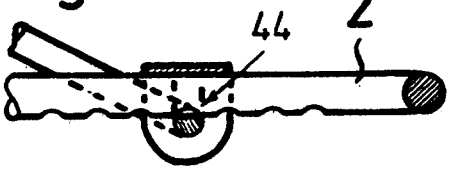
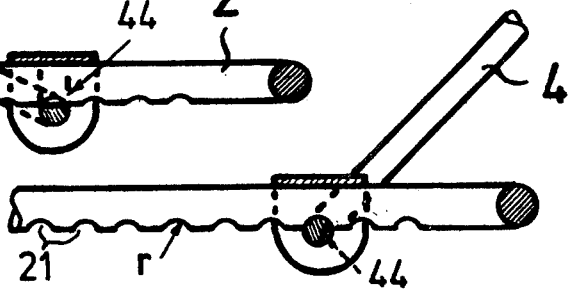
Fig.4

SKI BINDING WITH A FOOT SUPPORT

BACKGROUND AND SUMMARY OF INVENTION

The invention relates to a ski binding with a foot support on which a front toe bracket is fastened and which has frame including two rods which at least in the start-off position run parallel to the longitudinal direction of the ski and on which a rear heel bracket is mounted and equipped with a swingable heel holder. The frame is equipped with a number of recesses for adjusting the rear bracket in the longitudinal direction of the ski.

From DE-OS No. 26 07 270 there has become known a ski binding having a foot support. The bracket for the heel holding is made of several parts so that the bent ends of the bracket can be screwed into a fitting recess for the purpose of adjustment to a boot size. That makes the adjustment from one ski boot size to another size quite bothersome and time-consuming. The construction is expensive with the two bracket ends which can be screwed into a nut and which are connected with a U-shaped bracket by way of extension sleeves. The extension sleeves permit only limited adjustment.

It is the object of the invention to develop an adjustable holding device of this type which can be adjusted quickly and easily, is constructed simply and is inexpensive to produce.

The invention solves the problem by the fact that on each rod a U-shaped shackle is arranged which extends over the rod and through whose sides one of the bent ends of the rear bracket passes while extending under the rod and that the recesses are arranged on the side of the rod facing the upper side of the ski, that each bent side end of the bracket has a recess which in a position deviating from the start-off position can be brought under the respective recesses of the rod so that the bent end of the bracket is not in engagement with this recess and the bracket can be moved jointly with the two U-shaped hackles.

An embodiment of the invention is illustrated in the drawing.

FIG. 1 is a side elevational view showing a foot support with a ski boot fastened on it;

FIG. 2 is a top plan view showing the back part of the foor support with the adjustable holding device seen from above and in a larger scale than FIG. 1;

FIG. 3 is a sectional view taken along line III—III in FIG. 2 in an adjusting position and;

FIG. 4 is a view similar to FIG. 3 but with the parts arranged for skiing.

DETAILED DESCRIPTION

In FIG. 1, a part of a ski S is illustrated on which a binding with a sole plate P is fastened. The sole plate is held on the ski runner by means of a release device A which releases the sole plate in case certain torsional forces are exceeded during a fall of the skier. In front of the sole plate there is indicated at 1 the frame of a foot support which includes two parallel rods 2. In front at the frame there is linked a toe bracket 3 and in the back zone of the frame there is linked a springy elastic bracket 4 with a heel holder 5. The two brackets 3 and 4 with the heel holder 5 hold the ski boot H on the foot support.

In the back zone there is illustrated a removable holding device B by means of which the foot support can be firmly connected with the sole plate P or be released for skiing. The position during skiing is shown. With a U-shaped shackle 41 adjusted to the size of the boot, the heel holder 5 can—thanks to the springy elastic bracket 4—be swung beyond its dead center and push the sole of the ski boot strongly onto the frame of the foot support. For the adjustment to the size of the ski boot, the shackle 41 must therefore be adjustable on the frame. From FIG. 1 it is evident that also a large ski boot can find room on the foot plate.

By means of FIGS. 2–4, the adjusting system proper is described. The frame of the foot support is made of round material and includes the two parallel rods 2 which are connected with each other in their back zones. On their lower side (facing the upper side of the ski), the rods 2 are provided with a number of recesses 21. The recesses have a radius of curvature r which corresponds to a part of the cross-section (2r) of the resilient bracket 4 on the back side.

Two U-shaped shackles 41 extend over the rod 2 of which the frame of the foot support is made. The shackles are provided with bores through which the bent ends of the bracket 4 are inserted and reach under the rods of the foot support. In the start-off position, the ends 42 are in one of the recesses 21.

The bracket 4 is made of steel wire and is therefore resilient. Holding plates 43 are attached on the bracket ends located inside. Adjacent the longitudinal axis of the rod 2 there are provided in the bent ends 42 relatively shallow recesses 44 having a radius of curvature which corresponds to a part of the cross section of the rod 2 of which the frame of the foot support is made.

If the bracket 4 is swung into an adjusting position, for instance, as in FIG. 3, and pressed together, the recesses 44 are aligned with the rods 2 and the bracket 4 jointly with the shackles 41 can be moved on the rods 2 and the ends 42 to an adjacent recess 21. Alternatively, the ends 42 of the bracket 4 could also be longer so that they protrude into the frame of the foot support. The recesses 44 could then be inside the frame 2 and the adjustment in a non-operating position would consist of a pulling apart of the bracket 4. This variation is illustrated as an example for a bent end by broken lines in FIG. 2 where the recesses are designated 44'.

In summary, the foot support has two rods (2) running parallel to the longitudinal direction of the ski. For the purpose of adjustment to the length of a ski boot to be fastened on the foot support, the fastening elements (4, 5) on the back side are adjustable along the rods (2). The fastening elements include a bracket (4) having a heel holder (5). The bracket (4) is connected with the rods (2) by means of shackles (41). The rods (2) have a number of recesses (21) and the bent side ends (42) have also recesses (44).

For adjustment to the boot size, the bracket (4) is swung forward (FIG. 3). In that position, the recesses (44) permit the bracket (4) to be moved jointly with the shackles (41) on the rods (2) until it is under another recess (21). If the bracket (4) is now swung backward again (FIG. 4), the bent bracket ends engage in the recesses 21 so that bracket finds an engagement in this new position.

I claim:

1. Ski binding with a foot support on which a front toe bracket for a ski boot is fastened and which has two rods which at least in the skiing start-off position run parallel to the longitudinal direction of the ski and on which a heel bracket is provided equipped with a swingable heel holder, each bracket at its forward end being equipped with an inwardly bent end, said heel holder and heel bracket clamping the heel of said boot in the skiing start-off position, a number of recesses for adjusting said heel bracket being arranged on each rod in the longitudinal direction of the ski which serve to hold one of the bent ends of the bracket, characterized by the fact, that on each rod (2) a U-shaped shackle (41) is arranged which extends over the rod and through whose sides one of the bent ends (42) of the heel bracket passes while extending under the rod (2), and that the recesses (21) are arranged on the side of the rod (2) facing the upper side of the ski and shaped to conform to said bent ends, and that each bent end (42) of the bracket (4) has a recess (44) which when said heel bracket is in a position deviating angularly from the start-off position can be brought under the respective recess (21) of the rod (2) so that the bent end (42) of the heel bracket (4) is not in engagement with this recess (21) and the bracket (4) can be moved jointly with the two U-shaped shackles (41).

2. Ski binding as defined in claim 1, characterized by the fact that the recesses (44) on the back side of the bent ends (42) of the bracket (4) are laterally spaced from the longitudinal axis of the rod (2) in the start-off position and are laterally movable relative to the rods of the frame of the foot support by pressing the sides of the brackets together.

3. Ski binding as defined in claim 1, characterized by the fact that the recesses (21) at the bottom side of the rods (2) of the foot support are shaped to conform to a part of the cross section (2r) of the bent side end of the resilient bracket (4) and that the recesses (44) in the bent ends (42) of the heel bracket (4) are shaped to conform to a part of the cross section of the rod (2) of the foot support.

4. Ski binding as defined in claim 1, characterized by the fact that the recesses (44') in the bent ends (42) of the bracket (4) are located inwardly of the frame of the foot support and can be moved laterally relative to the rods (2) of the foot support frame (1) by pulling the heel bracket (4) apart.

5. A ski binding with a foot support comprising a toe bracket adapted to be secured to a ski, a frame pivotally secured to said toe bracket and including a generally U-shaped member having legs extending parallel to the length of said ski and a rear bight portion connecting said legs, said legs being notched at longitudinally spaced portions, a generally C-shaped bracket equipped with a heel holder positionably mounted on said frame, said C-shaped bracket having a pair of transversely extending ends each equipped with a shackle pivotally mounted thereon, each end being notched to accommodate movement along its associated leg and having a cross-sectional shape conforming to the shape of said leg notches, pivotal movement of said C-shaped bracket bringing the end notch into a position for registration with said legs, said C-shaped bracket being resilient to permit temporary deformation thereof to achieve registration of said end notches with said legs and thereby permit movement of said shackle along said legs into alignment with another leg notch.

* * * * *